US008656579B2

(12) United States Patent
Wojack et al.

(10) Patent No.: US 8,656,579 B2
(45) Date of Patent: Feb. 25, 2014

(54) METHOD OF FORMING A HOUSING WITH INTEGRAL ANTENNA

(75) Inventors: Jason P Wojack, Libertyville, IL (US); Joseph L Allore, Mundelein, IL (US); Gary R Weiss, Buffalo Grove, IL (US); Istvan J Szini, Grayslake, IL (US)

(73) Assignee: Motorola Mobility LLC, Libertyville, IL (US)

( * ) Notice: Subject to any disclaimer, the term of this patent is extended or adjusted under 35 U.S.C. 154(b) by 836 days.

(21) Appl. No.: 12/534,957

(22) Filed: Aug. 4, 2009

(65) Prior Publication Data

US 2010/0053002 A1 Mar. 4, 2010

Related U.S. Application Data

(60) Provisional application No. 61/092,799, filed on Aug. 29, 2008.

(51) Int. Cl.
*H01P 11/00* (2006.01)

(52) U.S. Cl.
USPC ..... 29/600; 29/592.1; 343/700 MS; 343/702

(58) Field of Classification Search
USPC ..... 343/702, 700 MS, 846; 29/600, 592.1, 29/832
See application file for complete search history.

(56) References Cited

U.S. PATENT DOCUMENTS

| | | | | |
|---|---|---|---|---|
| 4,894,663 | A * | 1/1990 | Urbish et al. | 343/702 |
| 6,097,339 | A * | 8/2000 | Filipovic et al. | 343/702 |
| 6,618,011 | B2 * | 9/2003 | Eggleston et al. | 343/700 MS |
| 6,806,835 | B2 | 10/2004 | Iwai et al. | |
| 6,861,989 | B2 | 3/2005 | Morningstar et al. | |
| 6,924,769 | B2 * | 8/2005 | Ito et al. | 343/702 |
| 7,091,911 | B2 | 8/2006 | Qi et al. | |
| 7,200,009 | B2 | 4/2007 | Narhi et al. | |
| 7,233,885 | B1 | 6/2007 | Larabee et al. | |
| 7,921,553 | B2 * | 4/2011 | Wojack et al. | 29/832 |
| 2001/0038616 | A1 | 11/2001 | Fong et al. | |

(Continued)

FOREIGN PATENT DOCUMENTS

| | | | |
|---|---|---|---|
| GB | 2422920 | A | 9/2005 |
| KR | 1020060068244 | A | 6/2006 |
| KR | 100787563 | B1 | 12/2007 |
| WO | 2005125158 | A1 | 12/2005 |

OTHER PUBLICATIONS

Lee, Saang Woong: "The International Search Report and the Written Opinion of the International Search Authority", Korean Intellectual Property Office, Daejeon, Republic of Korea, completed: Mar. 8, 2010, mailed: Mar. 9, 2010, all pages.

(Continued)

*Primary Examiner* — Minh Trinh
(74) *Attorney, Agent, or Firm* — Gary J. Cunningham

(57) ABSTRACT

A continuous housing (100) and integral antenna (102) and method (300) of forming a housing (100) and integral antenna (102), including: forming (305) an extrusion housing with a side opening defining a pocket configured to receive electrical components; removing (310) material of the extrusion housing in proximity to a wall portion of the extrusion housing; and forming (315) a desired antenna construction integral to the extrusion housing. Advantageously, the continuous housing (100) can form a wireless communication device, which is particularly adapted for mass production. This arrangement is adapted to allow a customer to design the look and feel of an electronic device.

11 Claims, 7 Drawing Sheets

(56) References Cited

U.S. PATENT DOCUMENTS

| | | | | |
|---|---|---|---|---|
| 2002/0057289 | A1 | 5/2002 | Crawford et al. | |
| 2003/0036367 | A1 | 2/2003 | Fuhrmann et al. | |
| 2003/0179143 | A1 | 9/2003 | Iwai et al. | |
| 2004/0217472 | A1 | 11/2004 | Aisenbrey et al. | |
| 2004/0222924 | A1 | 11/2004 | Dean et al. | |
| 2005/0032558 | A1 | 2/2005 | Chen | |
| 2005/0101356 | A1 | 5/2005 | Hutchison | |
| 2006/0214857 | A1* | 9/2006 | Ollikainen | 343/702 |
| 2007/0236870 | A1 | 10/2007 | Hachino et al. | |
| 2008/0167087 | A1 | 7/2008 | Tang et al. | |
| 2009/0247242 | A1* | 10/2009 | Wojack et al. | 455/575.1 |

OTHER PUBLICATIONS

Motorola, Inc.: "Method of Making a Customized Wireless Communication Device" Specification, U.S. Appl. No. 12/534,959, filed Aug. 4, 2009.

M. Dong Sung: "The International Search Report and the Written Opinion of the International Search Authority", Korean Intellectual Property Office, Daejeon, Republic of Korea, completed:Apr. 12, 2010, mailed: Apr. 13, 2010; all pages.

* cited by examiner

METHOD OF FORMING A HOUSING WITH INTEGRAL ANTENNA

FIELD OF THE INVENTION

The present invention relates generally to electronics device housings including user interfaces, and more particularly, to a continuous housing and radio frequency antenna.

BACKGROUND OF THE INVENTION

Electronic devices generally have a housing and electronic components contained therein. Some devices have multiple housing pieces coupled together while others are a single housing. Electronic components can include an antenna for RF communication. Antennas in these devices are coupled to the PCB or incorporated therein such as through copper portions of the PCB itself.

There is a need to allow a customer to design and customize the look and feel of his or her electronic device, such as wireless communication device.

A continuous housing with an integral antenna, which is configured for mass production, simplifies manufacturability and provides structural integrity, would be beneficial.

DETAILED DESCRIPTION OF THE DRAWINGS

Figure 1:
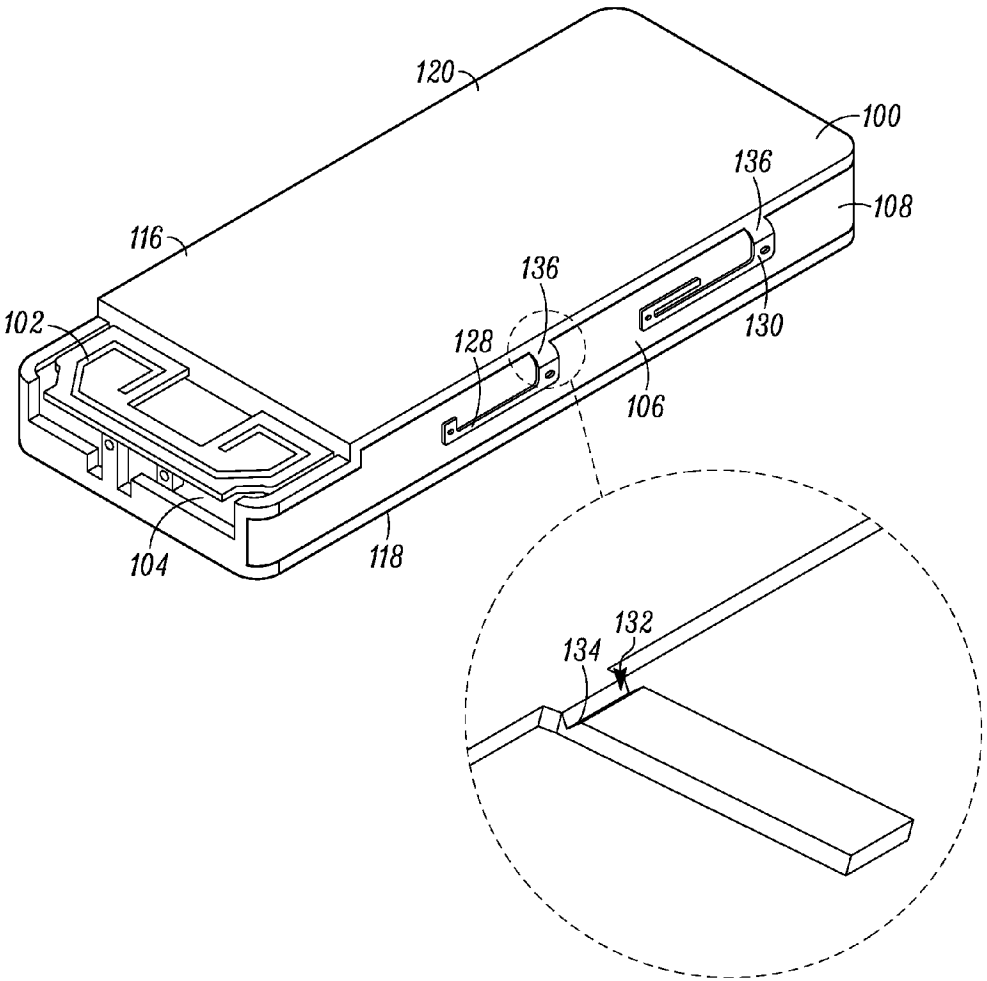
FIG. 1 is a perspective view from the rear of a continuous housing with integral antenna, the continuous housing can have a narrow profile with an open side adapted for receiving electronic components, in accordance with an embodiment of the invention.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Before describing in detail embodiments that are in accordance with the present invention, it should be observed that the present invention resides primarily in apparatus components and combinations of method steps related to the housing and integral user interface. Accordingly, the apparatus components and method steps have been represented where appropriate by conventional symbols in the drawings, showing only those specific details that are pertinent to understanding the present invention, so as not to obscure the disclosure with details that will be readily apparent to those of ordinary skill in the art, having the benefit of the description herein.

In this document, relational terms such as first and second, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Figure 2:
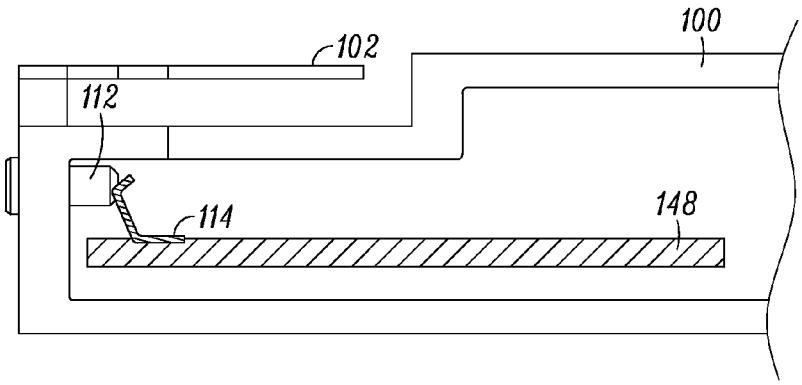
FIG. 2 is an enlarged partial side view of the integral antenna in FIG. 1, showing a connection between the antenna and a printed circuit board, in accordance with an embodiment of the invention.

In it's simplest form, as shown in FIGS. 1 and 2, the continuous housing 100 with an integral antenna 102 can include: a single substantially continuous extrusion housing 100 having a void portion 104 and an opening 106 defining a pocket 108 adapted to receive electrical components 110; and the void portion 104 being integral to the continuous housing 100 and being configured to substantially surround and form an integral antenna 102. Advantageously, this arrangement provides a robust and simple construction that is particularly adapted to being customizable and made to a customers order. An arrangement that is adapted to allow a customer to design and customize the look and feel of his or her electronic device, such as wireless communication device, is beneficial and attractive to a customer, and advantageous.

Advantageously, the continuous housing 100 forms a wireless communication device having an integral antenna 102, which is particularly adapted for mass production. In a preferred embodiment, the continuous housing 100 and integral antenna 102 comprise substantially contiguous encompassing surfaces on an outer periphery 136 of the housing 100, to enclose and surround electrical components on a plurality of sides, and the integral antenna 102 is formed from portions of the housing 100 material. In a preferred embodiment, the housing 100 and integral antenna 102 comprise a conductive material configured to form at least one antenna. In a preferred embodiment, the conductive material comprises aluminum, for providing desirable antenna characteristics and for providing a desirable ground.

In a preferred embodiment, the second forming step can include: forming a desired antenna construction, key pad construction and display opening integral to the extrusion housing. Thus, in this embodiment, keys with voids substantially surrounding three sides of each key and an opening for a display can be formed at the same time and in a substantially similar manner to the way the integral antenna 102 is formed, as detailed herein.

In more detail, the integral antenna 102 includes isolated portions of the continuous housing 100 such that the isolated portions help to form the integral antenna 102 geometry, thus providing the desired radio frequency characteristics. This can be accomplished by isolating the integral antenna 102 from the remainder of the housing 100 by at least one void portion 104 in the continuous housing 100. In one embodiment, there can be a plurality of voids in the housing 100 surrounding the one or more antenna(s).

In this embodiment, the integral antenna 102 is formed into the continuous housing 100 such that a portion of the housing 100 is isolated from the antenna 102 and a portion of the housing comprises a ground or ground plane. The integral antenna 102, in this embodiment, is formed by creating a void 102 in the material of the continuous housing 100. The void 102 creates the desired antenna shape or geometry, which in one embodiment can be a dipole antenna. The antenna shape, including the length, width and geometry determines the radio frequency operating bandwidth. For example, the antenna length and geometry can be made to operate in any desired band, and in one embodiment is formed to operate in a 800 MHz frequency band of a cellular radiotelephone system.

Figure 5:
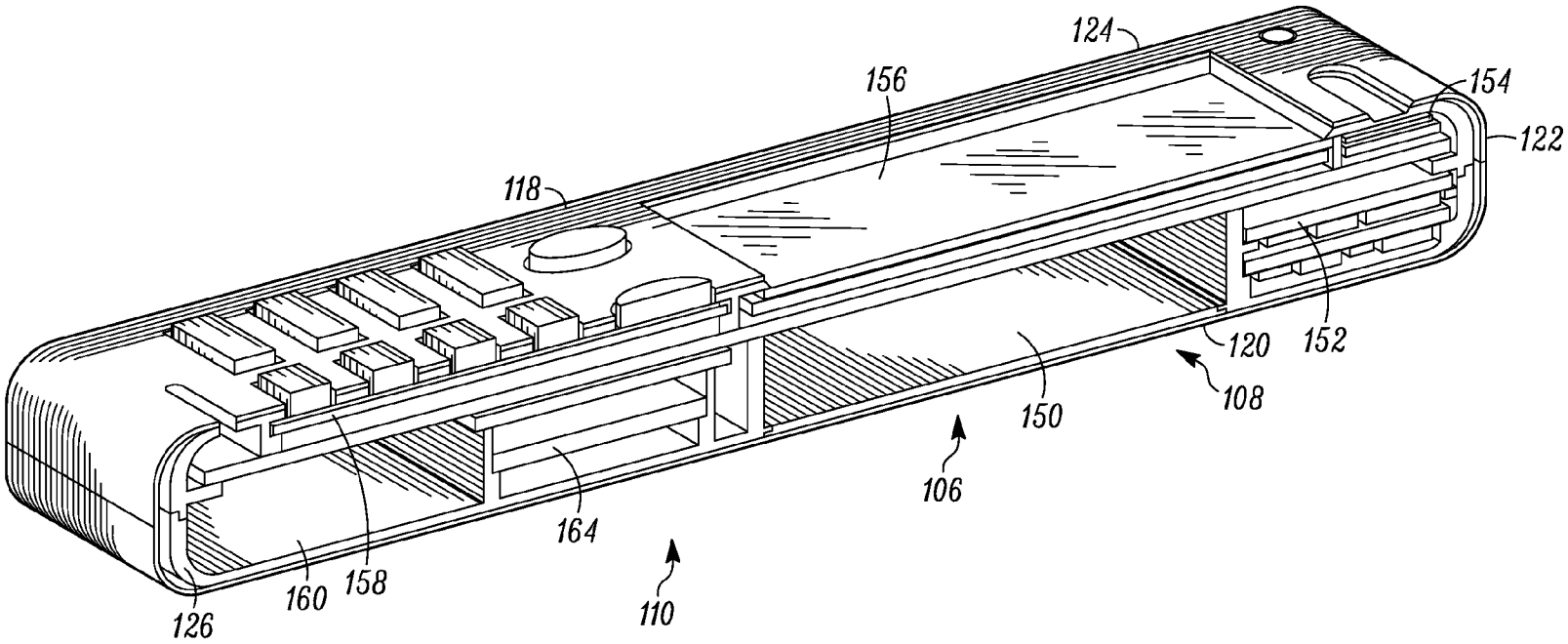
FIG. 5 is a perspective cut away frontal view of the continuous housing with integral antenna in FIG. 1, shown populated with electrical components in the form of a wireless communication device, in accordance with an embodiment of the invention.

As best shown FIGS. 1 and 5, in one embodiment, the continuous housing 100, can be a generally rectangularly shaped, narrow profile housing with a side opening 106 forming a pocket 108 to receive electronic components. As should be understood by those skilled in the art, however, there may be a plurality of sides having integral antenna(s) as shown in FIG. 1. Alternatively for example, the housing 100, as shown in FIG. 5, can have two sides, such as front and rear faces 118 and 120 with semi-circular interfaces or walls 122, 124 and 126 that meet to form an enclosure, i.e. a front 118 and a rear face 120 only. The outer periphery may be flat, non planar or a combination thereof, depending on the desired aesthetics and look and feel.

In one embodiment, the integral antenna 102 is incorporated into a bottom portion 116 on the rear face 120 of the device or housing 10 in FIG. 1. The integral antenna 102 can be a planar or folded inverted conformal antenna (FICA) style antenna. The antenna placement and geometry can provide a first feed, such as items 112 and/or 114 shown in FIGS. 2 and 3, to a PCB 148 and a second feed, such as bridge 166 in FIGS. 1 and 4, to ground, as provided in further detail herein. Here the antenna 102 can be three dimensional in geometry and can be incorporated into a plurality of sides of the housing, for enhanced portable construction. It is to be understood that a plurality of types of antennas may be integrally incorporated into the housing and that one of ordinary skill in the art will appreciate the variability in antenna types and characteristics.

Figure 4:
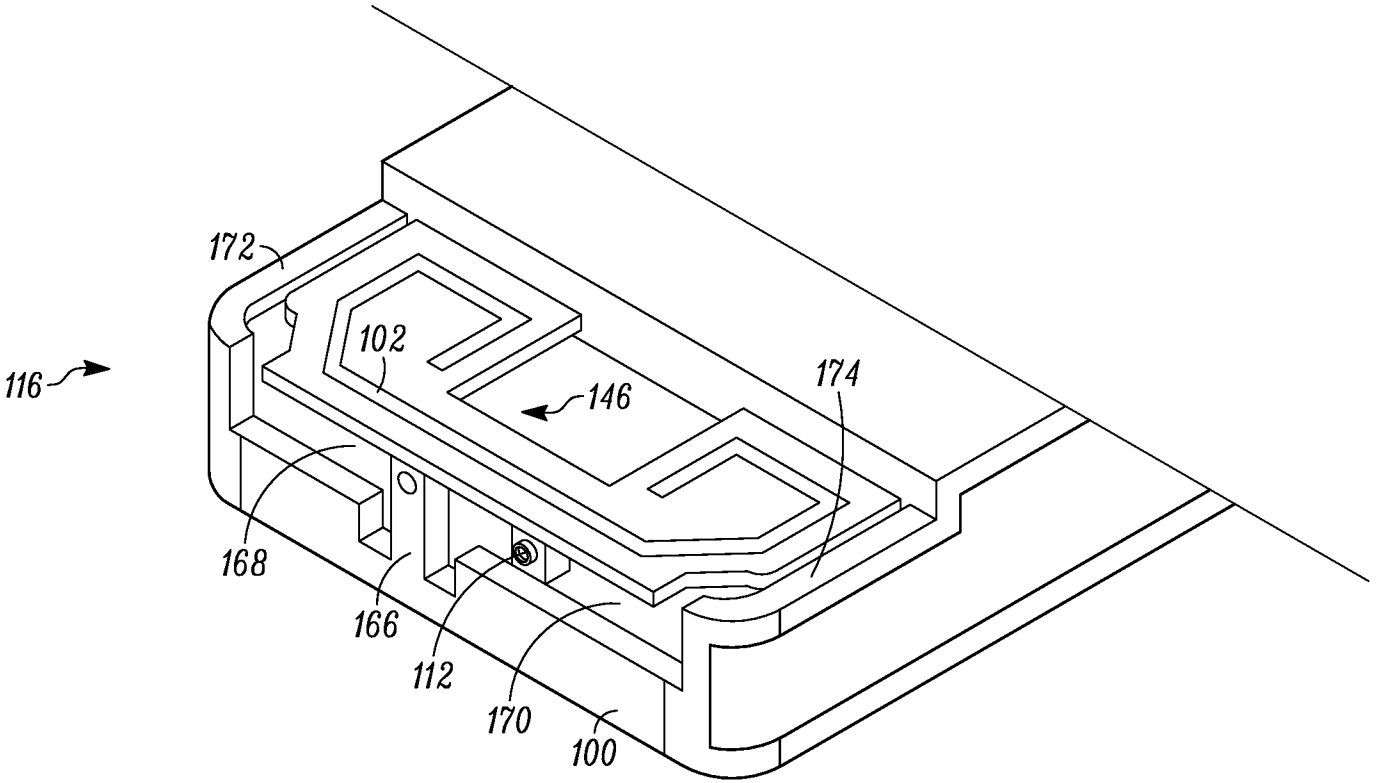
FIG. 4 is an enlarged partial perspective view of the integral antenna in FIG. 1, in accordance with an embodiment of the invention.

Referring to FIGS. 2 and 4, an antenna feed 112 couples the integral antenna 102 to an antenna interface 114 contact point of a printed circuit board (PCB) 148, as shown. In a preferred embodiment, this structure provides a secure and reliable electrical connection between a conductive integral antenna 102 and PCB 148 via the antenna interface 114. As is understood by those skilled in the art, the PCB 148 has conventional conductive transmission lines for connecting various circuits and RF componentry, which is not shown in the drawings.

Figure 3:
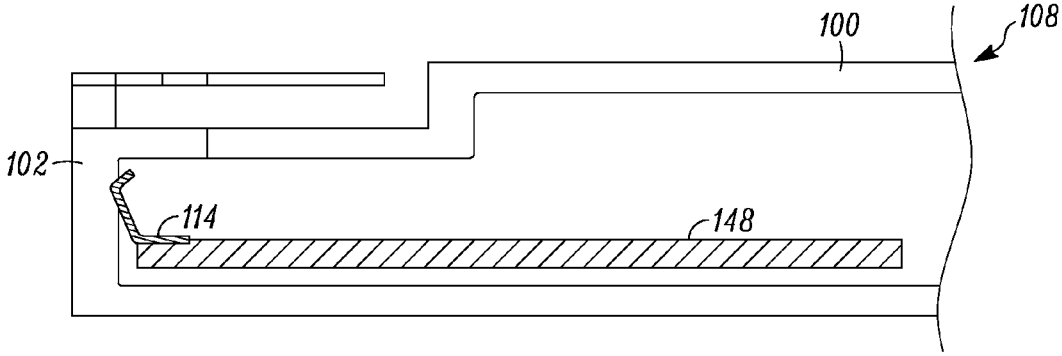
FIG. 3 is an enlarged partial side view of the integral antenna in FIG. 1, showing an alternate connection between the antenna and a printed circuit board, in accordance with an embodiment of the invention.

In FIG. 3, the antenna interface 114 connects the antenna 102 and PCB 158 directly, without the need of a screw, as shown in FIG. 2. As should be understood, the antenna feed 112 and antenna interface 114 can vary greatly, provided a secure connection is maintained between the integral antenna 102 and PCB 148.

As shown in FIGS. 1 and 4, in a preferred embodiment, the integral antenna 102 is formed and strategically placed in proximity to a bottom portion 116 of the continuous housing 100. Advantageously, this location is chosen to provide the antenna to be minimally interfered with, by a users hands and body, for improved communications.

In a preferred embodiment shown in FIG. 5, the housing 100 includes a front face (or wall) 118, a rear face (or wall) 120, a north wall 122, an east wall 124, an opening 106 on a west side and a south wall 126, which collectively form an open sided housing forming a pocket 108 adapted to receive electrical components 110. The housing 100 in FIG. 5 also shows a narrow profile construction including a battery compartment 150 for receipt of a battery, a daughter PCB and SIM card location 152 for receipt of such components, ear piece speaker 154, display 156, key pad module 158 including a PCB, metal stiffener, EL and domes, and a loud speaker chamber 160. This construction provides an attractive wireless communication device, such as a cellphone.

As best shown in FIG. 1, the continuous housing 100 can include a plurality of integral antennas formed in the substantially continuous extrusion housing 100. For example, a primary integral antenna can comprise item 102 and secondary antennas can include a first antenna 128 operating in a first radio frequency band and a second antenna 130 operating in a second frequency band. This construction can provide a multi-band cell phone arrangement.

In more detail, the first and second secondary antennas 128 and 130 can include a notch 132 adapted to provide a linear fold line 134. This arrangement provides an accurate fold and bend, adapted to be in alignment with and reside on an outer periphery 136 of the housing. Advantageously, this construction provides a smooth outer surface and an attractive device.

Figure 6:
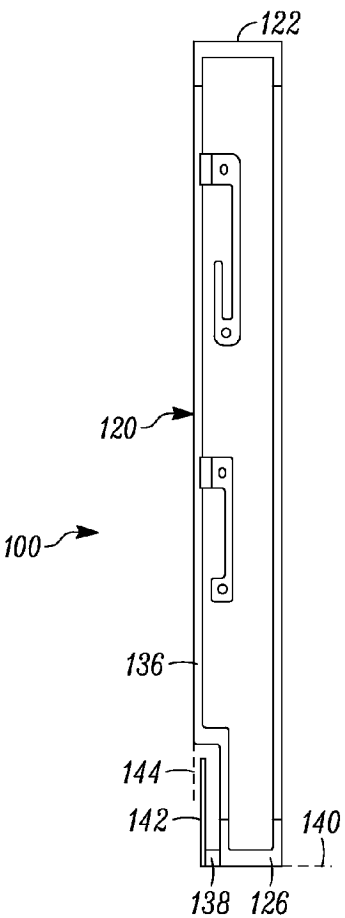
FIG. 6 is an enlarged side view of the continuous housing with integral antenna in FIG. 1, showing a narrow profile construction with a plurality of integral antennas located at the open side, in accordance with an embodiment of the invention.
Figure 9:
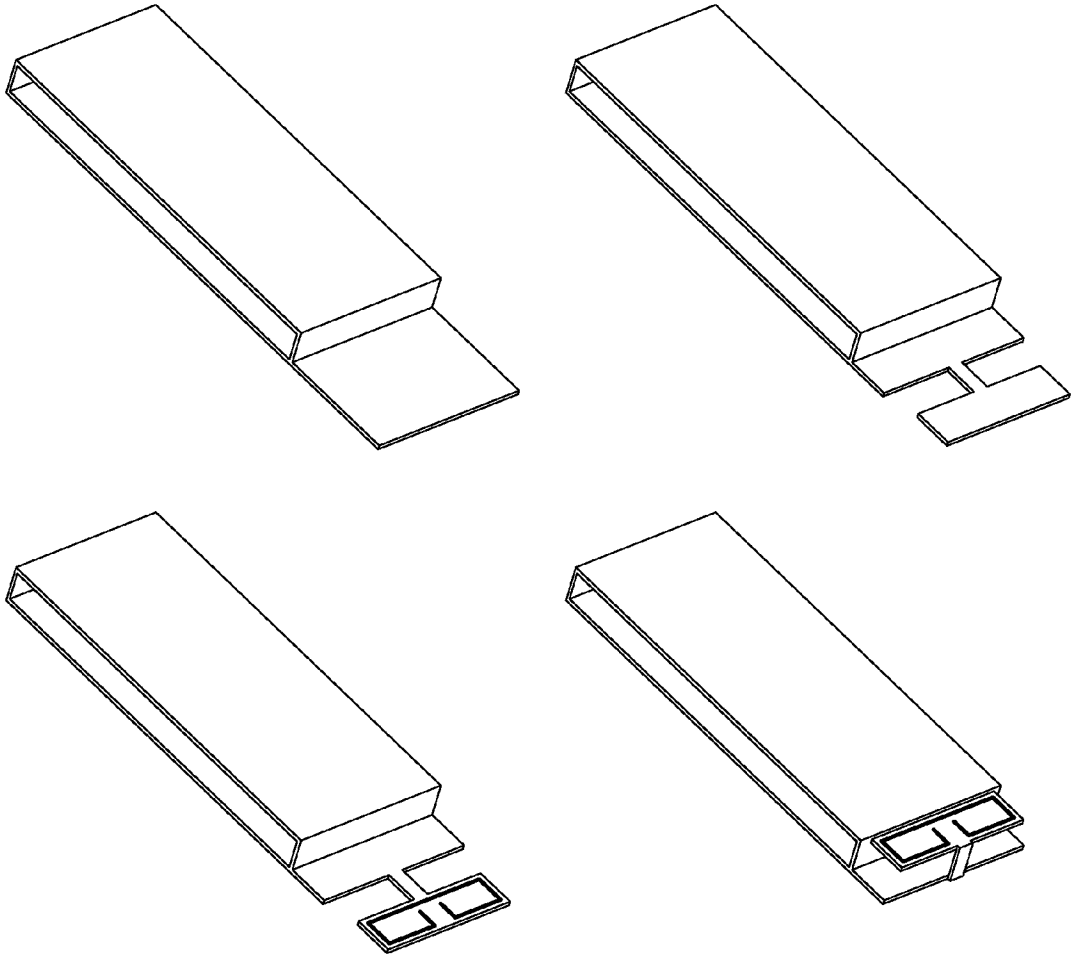
FIG. 9 is a simplified block diagram for a method of forming a housing with an integral antenna, such as a FICA style, including an extrusion step, machining a perimeter and providing notch for bends, laser cutting a desired antenna pattern and bending antenna into final position, in accordance with an embodiment of the invention.
Figure 10:
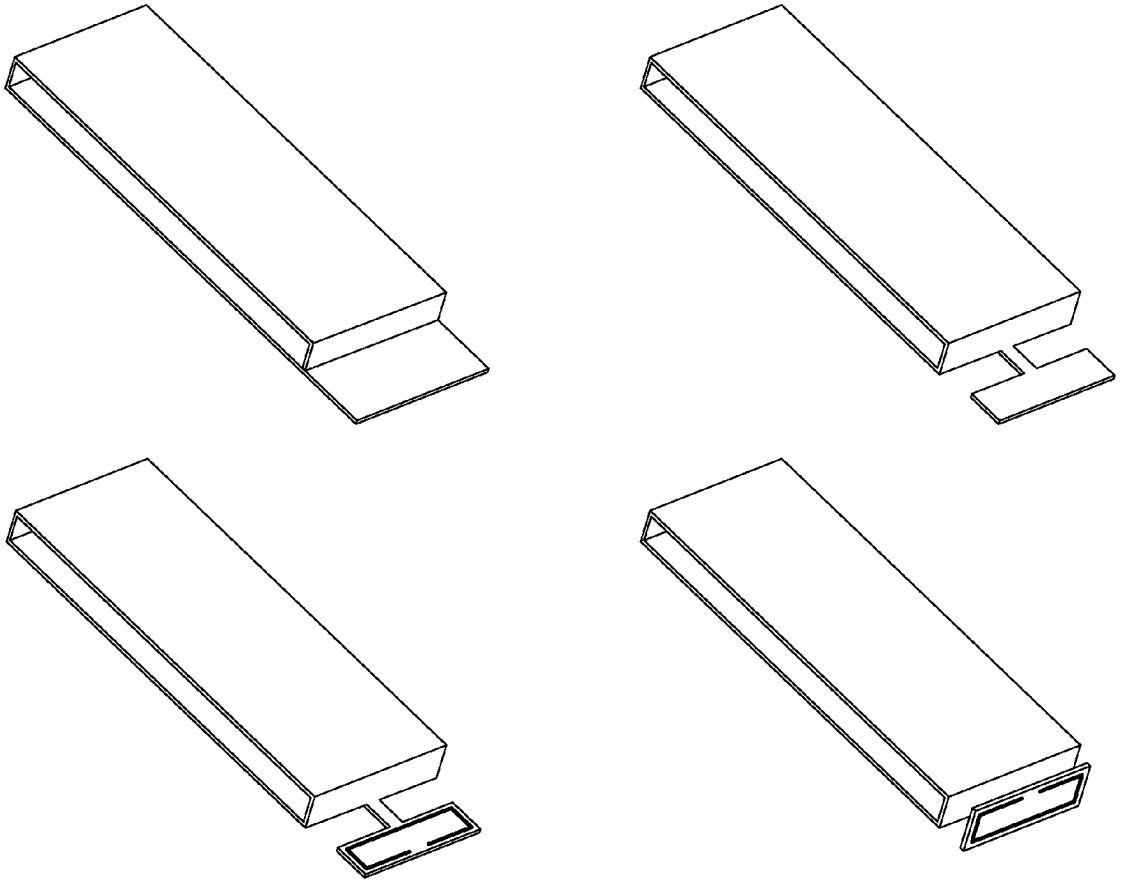
FIG. 10 is a simplified block diagram for a method of forming a housing with an integral antenna, such as a FJA style, including an extrusion step, machining a perimeter and providing notch for bends, laser cutting a desired antenna pattern and bending antenna into final position, in accordance with an embodiment of the invention.

As best shown in FIG. 6, the integral antenna 102 can also reside and be substantially aligned with on the outer periphery 136 of the housing 100. For example, in one arrangement the integral antenna 102 can include a first portion 138 extending substantially parallel to a first plane 140 defined by the south wall 126 (in phantom in FIG. 6) and a second portion 142 extending substantially parallel to a second plane 144 (in phantom) defined by the rear face 120. This arrangement provides a smooth outer surface adapted to receive an antenna cover, as detailed in connection with FIG. 7 As should be understood, various antennas can be utilized herein. Depending on the application, the integral antenna 102 can include at least one of a planar style antenna, a global positioning system (GPS) style antenna and other secondary antennas, such as Bluetooth, WLAN, LTE, FM, etc. antenna and the like, depending on the desire on the customer. In one arrangement, the conductor housing can be used as a "antenna farm", where a multiplicity of antennas can be aggregated to provide optimal antenna placement based on pre-determined user cases. The invention is adapted to provide multiple antenna placement options, for design flexibility. As best shown in FIG. 4, a bridge connection 166 connects the integral antenna 102 with the housing 100 to provide a ground plane. On each side of the bridge connection 166 are first and second open cavities 168 and 170, which are constructed to surround the antenna 112, for providing the desired RF characteristics.

Also shown in FIG. 4, are first and second rails 172 and 174 which are strategically located on either side of the integral antenna 102, to minimize undesirable hand effect caused by a user and provides desirable shielding. In more detail, the rails 172 and 174 are constructed to provide desirable shielding and maintain a user's hands away from the antenna 10, for minimal hand effect.

Figure 7:
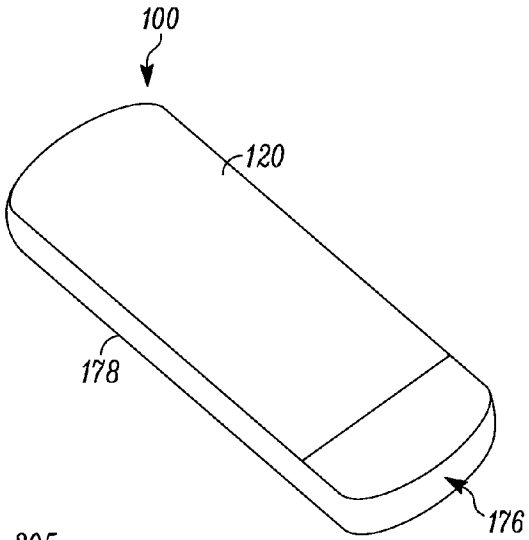
FIG. 7 is a perspective view from the rear of the continuous housing with integral antenna in FIG. 1, showing an antenna cover and side door forming a wireless communication device, in accordance with an embodiment of the invention.

Referring to FIG. 7, an antenna cover 176 and side door 178 are shown. In a preferred embodiment, they are made of a plastic, such as a polycarbonate, and are complementarily configured to connect with and wrap around portions of the outer periphery 136 of the housing 100, to cover and enclose the contents therein. The antenna cover 176 contributes to minimizing hand effect, and helps to distance a user's hands away from the antenna 102. And, the side door 178 is adapted to simplify replacement of SIM cards, batteries and the like. Preferably, they have curved external surfaces in alignment with the housing 100, to provide an attractive exterior appearance.

Figure 8:
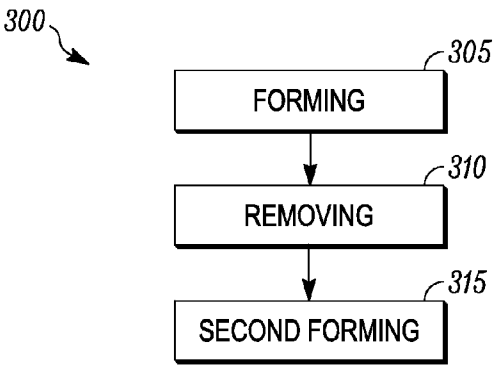
FIG. 8 is a simplified block diagram for a method of forming a housing with an integral antenna, in accordance with an embodiment of the invention.

Referring to FIG. 8, a block diagram of a method 300 of forming a housing and integral antenna is shown. It can include the steps of: forming 305 an extrusion housing with a side opening defining a pocket configured to receive electrical components; removing 310 material of the extrusion housing in proximity to a wall portion of the extrusion housing; and forming 315 a desired antenna construction integral to the extrusion housing. The method provides a simple and repeatable process of reliably making a housing adapted to receive electrical components, such as a wireless computing device, wireless communication device, cell phone and the like. The method is adapted to allow a customer to design and customize the look and feel of an electronic device.

In one embodiment, the method 300 can further include providing a secondary antenna(s) integral to the extrusion housing including at least one of a near field antenna, WiFi antenna, GPS antenna and FM antenna. In a preferred embodiment, this structure is provided in proximity to the side opening, to provide additional RF capabilities. Secondary antennas can be placed, for example, orthogonally to the extrusion, since there will be areas without metal to enable such assembly and placement, and proper radiation volume for electric small antennas.

In a preferred embodiment, the method 300 can include at least one of: configuring the pocket to receive at least one of a circuit board, a battery, a display, a subscriber identity module and a memory card substantially therein; providing a cover complementarily configured to enclose the pocket; and machining vias in the extrusion housing adapted to allow access from outside of the device to internally placed electrical components. Advantageously, this structure can provide a narrow profile wireless communication device with a means for connecting to periphery products, thus enhancing a user's experience.

In one embodiment, the method 300 can further include coupling the desired antenna construction to the circuit board; and providing a ground connection between the desired antenna construction and the extrusion housing. Advantageously, this provides desirable shielding.

In one arrangement, the method 300 can further include providing a ground structure configured to pre-load the desired antenna construction for minimizing external biologic energy dissipation effects generated by a user's head position and hand grip. In more detail and in a preferred embodiment, the providing step includes providing rails in proximity to the desired antenna construction, for minimizing undesirable external biologic energy dissipation effects, caused by a user's head or hand grip. This step and structure are configured to advantageously minimize undesirable hand effect, for example. In more detail, radiated structures typically suffer strong coupling with surrounding ground plane or dielectric loading. The grounded rails are configured to naturally provide a permanent antenna coupling. Therefore, the rails which provide pre-coupling with the radiated structure, are also constructed to minimize any extra undesirable dielectric loading provided by the users head position or hand grip (hand effect). Advantageously, the provided pre-loaded ground structure, for example, the rail construction, substantially prevents undesirable loading of the rails with head and hand dielectric loading, thus hand affect will not or will minimally affect the antenna frequency of resonance, thus the natural antenna resonance shift due to dielectric loading (head and/or hand), is minimized by the rails pre-coupling with the antenna, optimizing the antenna fractional bandwidth in any user case.

In one arrangement, the removing step 310 includes at least one of machining, laser cutting and stamping a portion of the extrusion housing. Other removal methods can be used herein, as understood by those skilled in the art.

In one arrangement, the forming step 315 can include bending a portion of an outer perimeter of the extrusion housing, to form a desired antenna construction.

In one arrangement, the method 300 can further include matching the extrusion housing 100 and the desired antenna construction, to provide at least one of a FICA style antenna, a GPS style antenna and a near field style antenna.

As should be understood, the matter set forth in the foregoing description and accompanying drawings is offered by way of illustration only and not by limitation. While particular embodiments have been shown and described, it will be apparent to those skilled in the art that changes and modifications may be made without departing from the broader aspects of Applicant's invention.

What is claimed is:

1. A method of forming a housing and integral antenna comprising:

forming an extrusion housing with a side opening defining a pocket configured to receive electrical components;

removing material of the extrusion housing in proximity to a wall portion of the extrusion housing;

forming a desired antenna construction integral to the extrusion housing; and coupling the desired antenna construction to the circuit board and providing a ground connection between the desired antenna construction and the extrusion housing, by; providing a ground structure configured to pre-load the desired antenna construction for minimizing external biologic energy dissipation effects generated by a user's head position and hand grip; and providing at least one of an antenna cover and a side door complementarily configured to connect to the pocket.

2. The method of claim 1 further comprising: providing a secondary antenna construction integral to the extrusion housing including at least one of a near field antenna, WiFi antenna, GPS antenna and FM antenna, in proximity to the side opening.

3. The method of claim 1 further comprising: configuring the pocket to receive at least one of a circuit board, a battery, a display, a subscriber identity module and a memory card substantially therein.

4. The method of claim 3 further comprising: coupling the desired antenna construction to the circuit board; and providing a ground connection between the desired antenna construction and the extrusion housing.

5. The method of claim 1 further comprising: providing rails in proximity to the desired antenna construction configured to minimize hand effect.

6. The method of claim 1 wherein the removing step includes at least one of machining, laser cutting and stamping a portion of the extrusion housing.

7. The method of claim 1 wherein the forming a desired antenna construction integral to the extrusion housing step, includes bending a portion of an outer perimeter of the extrusion housing.

8. The method of claim 1 further comprising: matching the extrusion housing and the desired antenna construction, to provide at least one of a FICA style antenna, a GPS style antenna and a near field style antenna.

9. The method of claim 1 further comprising: providing at least one of an antenna cover and side door complementarily configured to connect to the pocket.

10. A method of forming a housing with an integral antenna construction comprising:

forming an extrusion housing with a side opening defining a pocket configured to receive electrical components;

removing material of the extrusion housing in proximity to a wall portion of the extrusion housing;

forming a desired antenna construction integral to the extrusion housing;

coupling the desired antenna construction to the circuit board and providing a ground connection between the desired antenna construction and the extrusion housing;

providing a ground structure configured to pre-load the desired antenna construction for minimizing external biologic energy dissipation effects generated by a user's head position and hand grip; and providing at least one of an antenna cover and a side door complementarily configured to connect to the pocket.

11. A method for forming a housing for a hand-held electronic device in accordance with claim 10, wherein the providing step includes providing rails in proximity to the desired antenna construction, for minimizing undesirable external biologic energy dissipation effects.

* * * * *